United States Patent [19]

Hulstein et al.

[11] 3,991,704

[45] Nov. 16, 1976

[54] COATING APPARATUS

[75] Inventors: Calvin Hulstein, South Windsor; William Gelinas, Enfield, both of Conn.

[73] Assignee: Loctite Corporation, Conn.

[22] Filed: July 18, 1974

[21] Appl. No.: 489,767

[52] U.S. Cl. ..... 118/2; 118/107; 118/401

[51] Int. Cl.[2] ..... B05C 1/02; B05C 11/02

[58] Field of Search ..... 198/25, 103, 22 R; 118/308, 620, 230, 319, 2, 322, 107, 401

[56] References Cited

UNITED STATES PATENTS

| | | | |
|---|---|---|---|
| 2,917,169 | 12/1959 | Kingston et al. | 198/25 X |
| 3,090,476 | 5/1963 | Sanders | 198/103 X |
| 3,452,714 | 7/1969 | Burke et al. | 118/308 X |
| 3,498,352 | 3/1970 | Duffy | 118/308 X |
| 3,731,715 | 5/1973 | Gageant et al. | 198/22 R X |
| 3,778,292 | 12/1973 | Rood et al. | 118/2 X |
| 3,795,224 | 3/1974 | Batson et al. | 118/308 |

FOREIGN PATENTS OR APPLICATIONS

| | | | |
|---|---|---|---|
| 1,816,730 | 6/1970 | Germany | 118/322 |

*Primary Examiner*—John P. McIntosh
*Attorney, Agent, or Firm*—Watson, Cole, Grindle & Watson

[57] ABSTRACT

In order to form a band of coating material around the shanks of a plurality of headed articles, an arrangement is provided for conveying each article along a conveying path with a predetermined orientation past a coating applicator. The articles are initially supplied by a feeding device which emits, via a transfer device, the articles with the desired orientation onto the conveying path. The transfer device receives the articles from the feed device, accelerating them to a predetermined speed and transfers them to the subsequent conveying path with a predetermined minimum distance between each article. The subsequently arranged conveying path is formed by a pair of relatively horizontal and generally parallel conveyer elements, which elements are supported in a spaced relationship with a drive arrangement being provided for moving one of the elements relative to the other in a direction along the conveying path. The coating applicator is arranged adjacent to the conveying path subsequent to the transfer arrangement and is arranged for applying a band of material to the selected portion of the shanks of the headed articles. In the location of the coating applicator the elements are maintained in a closely spaced relationship so as to cause the article to be rotated and positively fed in a forward direction during the coating operation.

18 Claims, 11 Drawing Figures

COATING APPARATUS

BACKGROUND OF THE INVENTION

The present invention relates to an arrangement for applying a band of coating material to a selected portion of the shank of headed articles, such as, for example, bolts, rivets and other fasteners.

A basic system for applying such a coating is described in U.S. Pat. No. 3,795,224 to Robert E. Batson et al. As pointed out in this patent, in applying a band of material to the shanks of such articles, it is desirable to be able to maintain the quantity of material which is applied and to control the area of the shank over which the material is applied. In providing for such control of the size and quality of the band of coating material, it is necessary that the articles be fed in a predetermined orientation along a conveying path past a coating applicator with a predetermined distance between each of the articles.

The orientation of such articles must initially be set prior to the time at which the articles enter the conveying path. Additionally, it is necessary that the spacing between the articles be set prior to the time that the articles travel past the coating applicator. In order to provide for such a spacing between the articles, the system in the above-noted patent provides a conventional escapement mechanism positioned along the conveyor path. In the operation of this system, a stream of articles is initially fed onto the conveyor path with the appropriate orientation. The articles are subsequently engaged by the escapement mechanism which delays the continued passage of the articles and releases them with a set spacing between each article.

The articles are then conveyed past the coating applicator, where a selected quantity of material is applied to the shanks of the articles. After the material is applied, the coating applicator includes a smoothing block for smoothing the material out into the desired continuous band. This band of material, which is applied, helps to form a tight interlocking arrangement when the article is inserted into a corresponding threaded member. The coating material, which would be provided in applying such a band, is generally of a viscous or paste-like consistency and thus when applied covers in the threads of the shank of the article. In applying the coating material however it is necessary to maintain several of the bottom threads of the shank of the article free of the coating material so that these threads are free to initially engage the corresponding member for joining the article and the member together.

In carrying out such a coating process, it, therefore, becomes necessary to maintain a synchronized flow of the articles past the coating station with the articles rotating and moving in a forward direction past the coating device. As each article moves past the coating device, only a selected quantity of material is emitted from the coating device and this emission occurs in synchronization with the movement of the article.

The utilization of such a conveyor system, as descirbed in the above-noted patent, together with a track feeding system leads to several problems. At the junction of the track and the conveyor path, the articles have a tendency to easily jam thereby interrupting the process. There is also a tendency of the articles to pile up along the conveyor path in the area between the junction with the track feed and the escapement mechanism. Since the conveyor elements are flexible members, when the articles pile up there is a tendency for conveyor members to bulge thereby causing the articles to drop out of the path. Furthermore, with the utilization of a conventional escapement mechanism, the conveyor members have to grip the articles within the escapement area to permit emptying and, consequently, the escapement function itself tends to fight the grip of the conveyor members.

SUMMARY OF THE INVENTION

An object of the present invention is to provide an improved arrangement for applying a band of coating material around the shanks of headed articles.

Another object of the present invention is to provide an arrangement in which the articles to be coated are fed past the coating applicator in a substantially continuous flow while maintaining a substantially constant distance between successive articles.

Still another object of the present invention is to provide an arrangement having an escapement mechanism which positively feeds the articles onto the conveyor path in such a manner as to avoid the previously-mentioned problems.

A further object of the present invention is to provide an arrangement in which both the quantity of coating material applied to the shank of the headed articles and the portion of the shank over which the coating material is applied are substantially maintained at their respectively selected levels.

In order to accomplish these objectives, a coating arrangement is provided in which the articles are fed onto a conveyor path with a substantially constant distance between them and subsequently pass by a coating applicator, which is operated in synchronization with the movement of the articles in such a manner so as to selectively emit a controlled amount of coating material. Accordingly, the articles are initially supplied by a feeding device and are subsequently conveyed along a predetermined path past the coating applicator by a conveyor device. A transfer device, also known as an escapement mechanism, receives the articles from the feeder and transfers them to the conveyor with a predetermined minimum distance between each of the articles. The coating applicator is arranged adjacent to the conveyor along the path travelled by the articles in such a position so as to be capable of coating the shanks of the articles with the coating material.

The transfer device provides an actual positive feed force in transferring the articles from the feeder onto the conveyor device, in contrast to the delay escapement utilized in the previously noted patent. During this transfer process the articles are accelerated approximately up to the speed of the conveyor device, so that as the articles leave the transfer device and enter the conveyor device there are no significant frictional counter-acting forces created between the two devices. Since the transfer mechanism positively feeds the articles onto the conveyor path, the problems of the jamming up of the articles and the possibility of articles dropping from the conveyor path, which were previously encountered, are now eliminated.

The conveyor includes a pair of relatively horizontal and generally parallel conveyor elements which are supported in a spaced relationship between the elements. A drive arrangement is provided for moving one of the conveyor elements relative to the other element in a direction from the transfer device towards the coating applicator. At the location immediately adjacent the transfer device, the conveying elements are spaced by a distance which is sufficient to receive the shanks of the articles which are to be coated, but by a distance which is less than the diameter of the heads of the articles so as to enable the shanks of the articles to be easily fed into the space between the elements. The articles upon being thrust into the space between the conveying elements are frictionally gripped and positively fed in succession past the coating applicator while the desired spacing between the articles on the conveyor is still maintained.

In accordance with one embodiment of the present invention, the feeder can consist of two bars arranged parallel to one another with one end of the bars being capable of receiving the articles and the other end of the bars being adjacent to the input of the transfer device. By either placing the bars at a slope with respect to the transfer device or by causing the bars to vibrate, it is possible to move the articles from the first end of the bars towards the transfer device. It is also possible to utilize both of these procedures for providing an improved system for the movement of the articles along the feed path. A guide plate can be arranged above the bars for preventing the articles travelling between the bars from leaving the feed path. The guide plate is generally arranged so as to be adjustable depending upon the height of the head of the articles, with only a minimal spacing being provided between the head and the guide plate.

In a preferred embodiment of the transfer device, a star-wheel escapement mechanism is provided. The utilization of a star-wheel escapement mechanism provides several advantages. Since the mechanism can accelerate the articles up to the linear speed of the conveyor members prior to their being fed onto the members, the tendency of the articles to jam up is significantly reduced. This acceleration feature also allows for greater latitude in the tolerances of the conveyor members at the inlet end since the articles are effectively thrown into the grip of the conveyor members. The use of the star wheel escapement mechanism furthermore enables the utilization of a slip clutch and flexible pinch point at the conveyor inlet which further helps to eliminate any possibility of jamming of the articles. The utilization of such a mechanism also simplifies the conveyor device since the escapement mechanism is no longer on the conveyor path.

The star wheel in this mechanism has a plurality of openings, with each opening being capable of receiving one of the articles. The star wheel is interchangeable with other wheels with different size openings which correspond to the size of the shanks of the articles which are to be coated. By rotating the wheel, the openings travel past the output end of the feeder so as to receive the articles, one at the time, and the wheel subsequently feeds the received articles onto the conveyor elements. In order to maintain the articles within the openings of the star wheel during the transfer operation, a guide block is positioned adjacent to the star wheel and has one of its faces formed in a curved shape so as to correspond with the rotational path of the star wheel. Thus, the articles are maintained in the opening between the wheel and the guide block. The transfer mechanism also includes a deflection plate which is mounted at the junction point between the output end of the feed bars and the receiving point of the star wheel for guiding the articles leaving the feeder device onto the star wheel. The position of this deflection plate can be adjusted in dependence upon the size of the articles so as to either decrease or increase the size of the entry path for the articles.

In the conveyor system, while it is possible to utilize guide wires for both of the conveyor elements, it has been found to be preferable for one of the elements to be a stationary bar. This alternative has been deivsed since when utilizing wires for both of the elements it is possible for a pressure to build up due to a bunching up of the articles along the conveyor path and to cause a bulge between the wires thereby causing an interruption in the movement of the articles and a possible loss of the articles by dropping through the wires. By providing a stationary bar however for one of the elements, this drawback is substantially eliminated and a more even and consistent flow of the articles along the conveyor path is provided. Furthermore, the outer surface of the stationary bar, which faces the conveying path, can be formed in various shapes in dependence upon the shape of the article which is to be coated so as to provide better support for the articles.

The coating applicator is arranged adjacent to the conveyor path in a position for applying the coating material to a selected portion of the shank of each article. This applicator is constructed so as to be capable of emitting a selected quantity of material in synchronization with the movement of the articles past the coating applicator. The applicator includes a coating block which has an opening therein through which the coating material can be emitted. It is possible to adjust the location of the coating block both in a vertical and horizontal direction in dependence upon the length and width of the bolt which is to be coated. Accordingly, if an extremely long bolt is to have a lower portion thereof coated with the coating material, the coating block can be lowered so as to be adjacent the portion of the shank of the article which is to be coated. Additionally if the shank of the article has a relatively large diameter, the coating block can be moved in a horizontal direction so as to provide additional space for the passage of the shank.

The coating material to be applied by the applicator is stored within a supply tank and is held under pressure conditions. The pressure conditions cause the coating material to travel from the supply tank to the opening within the coating block and to be emitted therefrom. The emission from the opening is controlled by the operation of a valve which is selectively activated so as to open and allow the release of coating material through the opening in the coating block in synchronization with the movement of the articles past the opening. After the coating material has been applied to the shank of the article, the article moves past a smoothing block for smoothing out the coating material into a continuous band around the shank of the article. Since the article is being fed in a forward direction with rotational movement, the smoothing block spreads the coating material around the entire circumference of the shank and causes the formation of a relatively continuous and even band around the shank of the article.

In other embodiments of the coating arrangement, it is possible to utilize either an elongated slot or a plurality of aligned holes for forming the opening in the coating block. Additionally, in order to synchronize the emission of the coating material with the movement of the articles, a sensing arrangement may be provided between the transfer device and the coating arrangement for providing activating signals in response to the passage of the articles. These activating signals, with an appropriate delay factor, are connected for activating a valve, e.g., a pinch valve, so as to open when the articles pass by the opening in the coating block.

While in the operation of the coating applicator, the material is only applied over a selected portion of the shank of the articles, due to the viscous nature of the material it is possible for some of the material to flow down along the shank to the lower portions of the shank. In order to prevent the lower threads of the shank of the article from being coated with a coating material, a jet spray of a fluid, e.g., air or water is directed towards these lower threads for cleaning off any of the material which accidentally reaches this area. Finally, after the coating material has been formed on the desired portions of the shanks of the articles, the articles are sprayed with a solution of water-soluble oil and optionally, a firming agent prior to their emission from the conveyor path.

DESCRIPTION OF THE PREFERRED EMBODIMENTS

Figure 1:
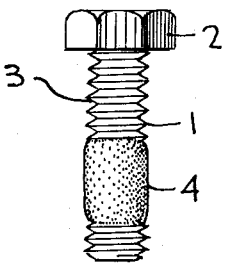
FIG. 1 is an elevational view of a headed article which has had a selected portion of its shank coated with a band of coating material.

As shown in FIG. 1, an article on which the coating material is to be applied, has a head 2 and a threaded shank 3. A portion of the shank is covered with a band of coating material 4, which band does not extend all the way to the bottom of the shank and therefore leaves at least a few threads at the bottom portion of the shank. These lower threads on the shank are kept free of coating material so that the article can be easily inserted into a correspondingly threaded article via these initial threads.

Figure 2:
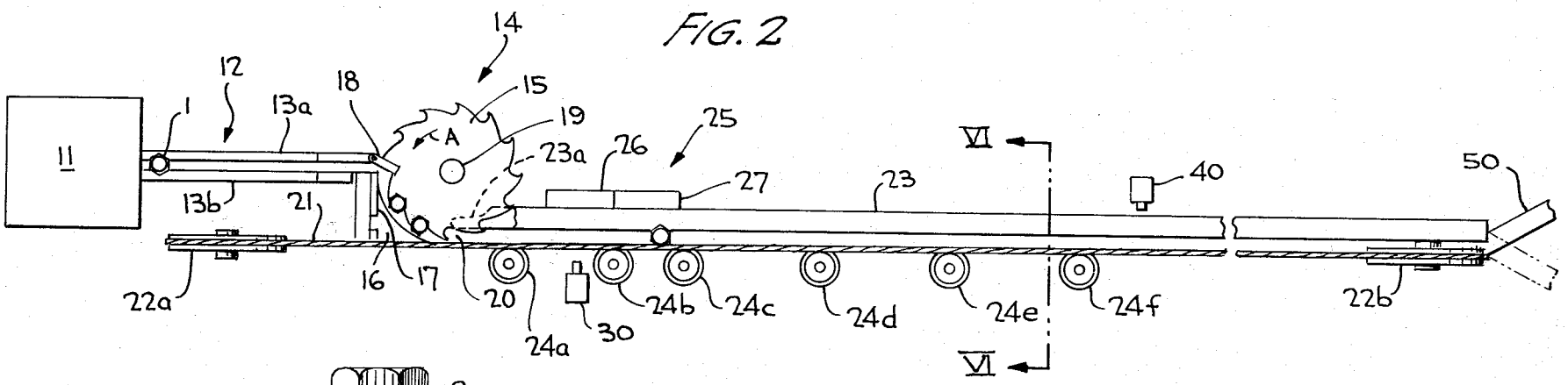
FIG. 2 is a plan view schematically illustrating the coating arrangement of the present invention, with the guide plates being removed so as to provide a clear illustration of the remaining elements.

A plurality of such articles are fed from a supply source 11 to a feeder device 12 as illustrated in FIG. 2. The feeder device 12 includes two parallel spaced bars 13*a* and 13*b* with the end of the bars adjacent the supply source 11 being capable of receiving an article 1 between the bars. The opposite end of the bars is positioned adjacent a transfer device 14 and feeds the articles into this arrangement 14.

The transfer device 14 includes a star wheel 15 which is mounted so as to rotate about the axis 19 in the direction shown by the arrow A. The star wheel is driven by a motor, which can be arranged beneath the star wheel. Openings 20 within the star wheel thus travel past the output end of the feeder device so as to receive the articles 1. Each opening 20 is dimensioned so as to be large enough to only receive the shank of one article at a time. In order to insure that only one article enters each opening and also so as to guide the article into the opening, a deflection plate 18 is provided.

As the star wheel rotates in its forward direction, the article 1 is held in place within the opening 20 by the guide block 16. This guide block 16 is formed so as to provide a surface, which faces the star wheel and is spaced by an equal distance from the axis 19 so as to substantially correspond to the rotational path of the wheel. A spring biased bar 17 is provided on the guide block 16 at the end of the block adjacent the output end of the feeder device 12 for directing the articles into the openings 20. If an article should become caught in this area, the spring biased member 17 is capable of being deflected in a direction away from the output end of the feeder arrangement so as to expose a curved surface of the guide block 16, thereby increasing the size of the opening and enabling the bolt to move along this curved surface into the opening 20.

The conveyor path is defined by the conveying elements, guide wire 21 and stationary bar 23. The guide wire 21 is mounted around the drums 22*a* and 22*b* so as to be capable of being moved along the conveyor path.

While the feed path of the feeder device 12 and the conveyor path are illustrated as being parallel to each other, the feed path can be orientated at any angle with respect to the conveyor path. It, therefore, is possible for several feeders to be arranged around the transfer device 14, with any one of the feeders selectively supplying articles to the transfer device.

The articles which are being transported by the star wheel 15 are accelerated to the linear speed of the conveyor and fed into the space between the guide wire 21 and the stationary bar 23. As the article 1 moves around from the feeder device 12 to the conveyor path the shank of the article comes into contact with the extended portion 23*a* of the stationary bar 23, which portion causes the article 1 to leave the opening 20 and to be thrust into the space between the conveyor elements. At this location where the article 1 enters the conveyor path the conveyor elements, guide wire 21 and the stationary bar 23, are spaced by a distance which is larger than the diameter of the shank 3 of the article 1 but smaller than the diameter of the head 2 of the article. At this location where the article enters the conveyor path, the guide wire 21 is urged toward the stationary bar 23 by roller 24*a* thereby frictionally gripping the article 1 between the two conveying elements. Rollers 24*b* through 24*f* continue to press the guide wire 21 toward the stationary bar 23.

The article 1 then passes through a coating applicator 25, at which location the coating material, or slurry, is applied to the shank of the article 1. This coating applicator 25 includes a coating block 26 and a smoothing block 27. The coating block is provided with an opening 29 through which the coating material is emitted onto the passing article. The emission of the coating material from the coating block is controlled in synchronization with the movement of the article past the coating block, as will be further described below. The quantity of coating material will normally be of a sufficient amount so that the rolling engagement of the shank with the surface of the coating block will cause the coating material to fully occupy the spaces between the roots and crests of the adjoining threads.

The movement of the guide wire 21 continues to roll the shank of the article over the smoothing block 27 at which location the coating material is smoothed out so as to form a substantially continuous band around the selected portion of the shank. The position of the coating block 26 can be adjusted both in a vertical and horizontal direction, which adjustment would be in dependence upon the length and width of the shank of the article to be coated. Accordingly, for example, if a longer bolt shank was to be coated, then the coating block 26 can be lowered so as to be properly positioned adjacent to that portion of the shank to be coated and likewise if the shank had a larger diameter the block could be moved back so as to accommodate the increased size of the shank.

As discussed above, it is generally desirable to leave the lower few threads of the shank free of coating material. Where the coating material is of a substantially viscous nature, it becomes desirable to provide a special arrangement for insuring that these lower threads remain substantially free of coating material. Accordingly, a cleaning device is provided for removing excess coating material which may cling to the shanks in the form of globs or droplets of material and tend to flow towards the bottom of the shank by the force of gravity. Such a cleaning device can include a spray nozzle 30 for spraying a jet stream of fluid at the lower threads for washing away any coating material which reaches this area.

This articles after leaving the coating applicator 25 continue along the conveyor path past a subsequently arranged spray system 40, which sprays a solution of a water-soluble oil and a firming agent onto each of the articles, and continues to the output end of the conveyor system onto the output conveyor 50. The output conveyor 50 is capable of being moved back and forth along a horizontal path for spacing the output of the articles onto a subsequently arranged conveyor belt, from which point the articles proceed to be fed into a heater for drying the articles. As the articles continue along the conveying path the guide wire 21 continues to be urged towards the stationary bar 23 for continuing to provide the friction engagement of the conveying elements with the articles for feeding the articles along the path.

Figure 3:
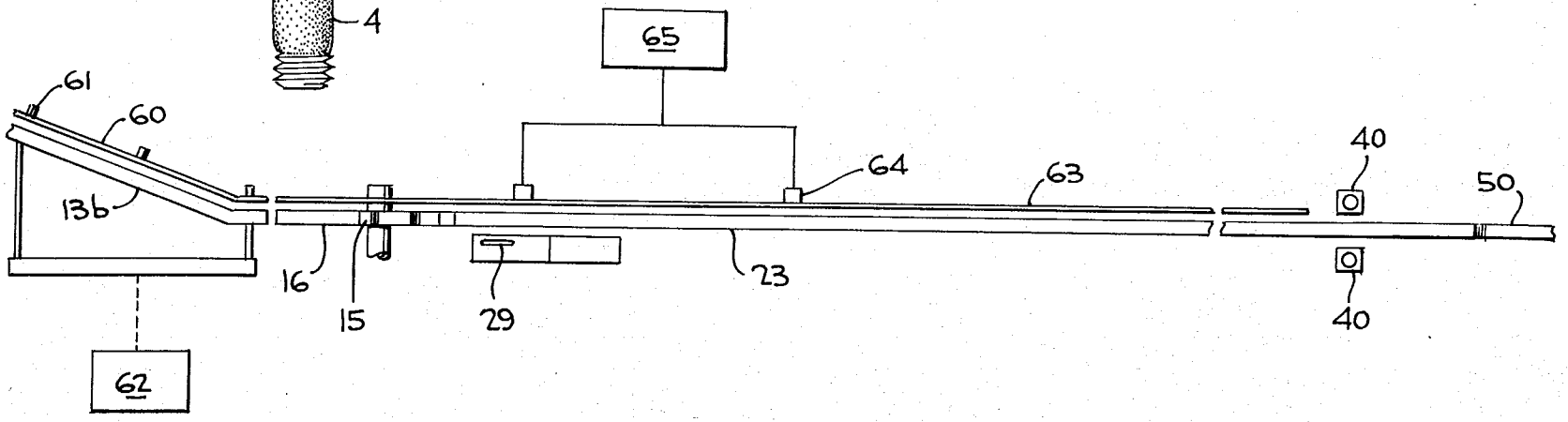
FIG. 3 is a side elevation view of the coating arrangement shown in FIG. 1 with the guide plates in place and the cable and rollers being removed.
Figure 4:
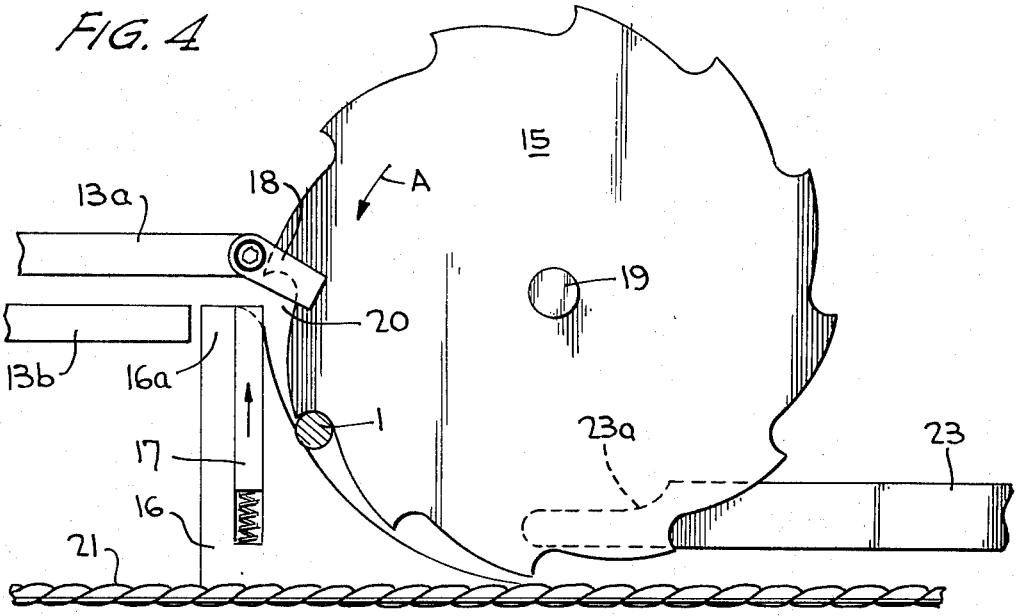
FIG. 4 is a partial plan view of the transfer mechanism in accordance with the present invention with an illustration of its cooperation with the feeder and the conveyor.

In constructing the feeder device 12, the feeder bars 13*a* and 13*b* can either be arranged at a slope so that the bolts flow from the input end towards the transfer device by the force of gravity or the bars can be vibrated so as to cause the movement of the bolts. It is furthermore possible to utilize both a combination of the formation of the slope and a vibrator for causing the movement of the articles along the bars. Accordingly, as shown in FIG. 3, the bars 13*a* and 13*b* would be arranged with their input end at a height above the level of the conveying path, with the bars being sloped from the input end towards the level of the conveyor with only the output end of the bars being substantially horizontal. These bars are mounted on a set of mounting brackets which additionally can be connected to a vibrator mechanism 62 for vibrating the bars. A guide plate 62 is arranged above the bars with its height being adjusted by the clamping elements 61. The guide plate 60 is lowered so as to only allow sufficient room for clearance of the head of the articles being fed between the bars, thereby preventing the articles from leaving the feeder path.

A similar guide plate 63 is arranged above the conveying path for preventing the articles from leaving this path. This plate 63 is clamped into position by clamps 64 which are controlled by a pneumatic device 65.

Figure 5:
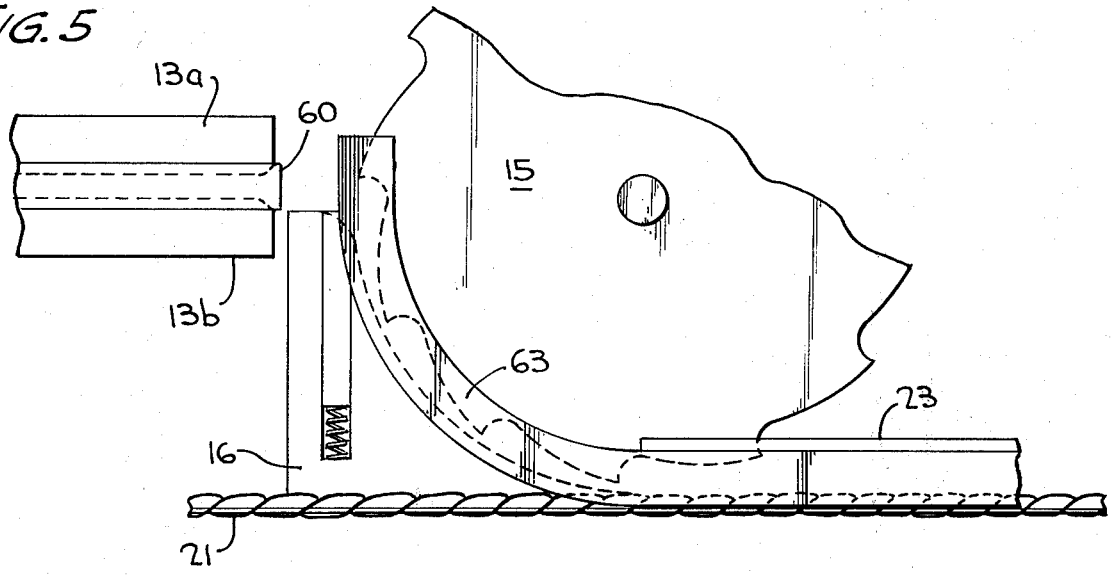
FIG. 5 is a partial plan view of the transfer mechanism showing the relationship of the guide plates to the feed path, the transfer mechanism and the conveyor path.

The arrangement of the guide plates 60 and 63 with respect to their respective paths is illustrated in FIG. 5. As shown, the guide plate 60 is arranged above the feeder bars 13*a* and 13*b* and the guide plate 63 is arranged above the star wheel 15, the guide block 16, the cable 21 and the stationary track 23. The guide plate 63 substantially picks up where the guide plate 60 ends so as to continue to prevent the articles from leaving the respective paths.

It is furthermore noted with respect to the feeder arrangement, that it is possible for the articles to be initially fed in an upside down orientation, i.e., the heads of the articles being on the bottom. Such a procedure could be followed where the article has a relatively large head and a relatively short shank. In such a situation, the guide plate and feeder bars would be positioned in an upside down arrangement and would then be gradually curved so as to be rotated by 180° into the upright position shown in FIG. 2.

As the article 1 leaves the space between the feeder bars 13*a* and 13*b*, it enters into the first available opening 20 in the star wheel 15. In order to insure that only one such article enters each opening, a deflection plate 18 is provided for closing off a portion of the opening so that the opening is only large enough to receive one article at a time. If two articles should accidentally become jammed in this area thereby preventing the furthermost article from entering the opening with the narrow space of the opening, the spring biased member 17 is deflected in a direction away from the opening. The movement of member 17 exposes a curved portion 16*a* of the guide block 16 thereby enlarging the opening for receiving the article and enabling the article to pass along this curved portion into the opening in the star wheel.

As the article 1 travels along with the star wheel towards the conveyor elements, the article will come into contact with an extended portion 23*a* of the stationary bar 23. This extended portion 23*a* of the stationary bar causes the article 1 to be removed from the opening in the star wheel and urged into contact with the cable 21. The cable 21 then frictionally engages the article and proceeds to convey the article along the conveyor path. In this manner the articles are fed from the feeder arrangement onto the conveyor path with a predetermined spaced relationship between each of the articles.

Figure 6A:
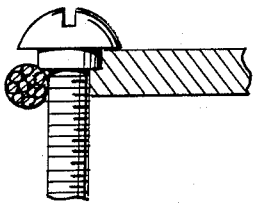
FIGS. 6*a*, 6*b* and 6*c* are illustrations along lines VI—VI in FIG. 2 showing various forms for the stationary bar member of the conveyor system and the corresponding articles for which these bars would be utilized.
Figure 6B:
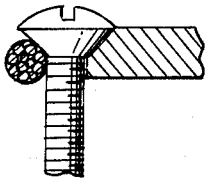
Figure 6C:
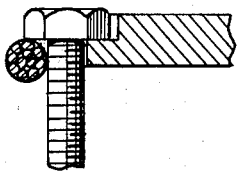

The stationary bar of the conveying path can be constructed with a projection on its lateral face which faces the conveying path. This lateral face can take several different forms such as shown in FIGS. 6*a* through 6*c*. The shape of the projection on this lateral face would depend upon the specific shape of the article which is to be conveyed along the path. The stationary bar, therefore, is generally mounted on the machine in such a manner as to be replaceable with various other bars depending on the shape of the articles to be coated.

Figure 7:
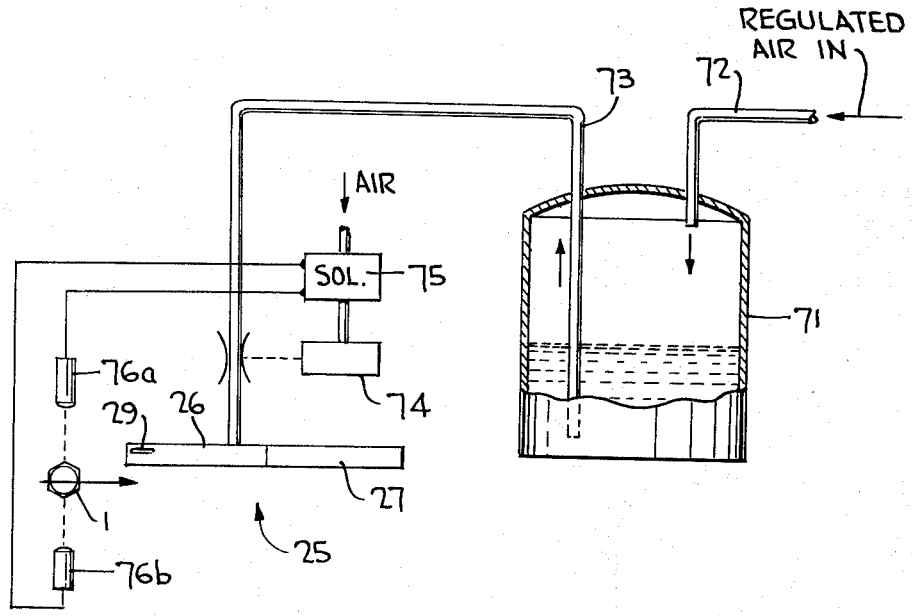
FIG. 7 is a schematic illustration of the coating applicator in accordance with the present invention.

An embodiment of the coating applicator is schematically illustrated in FIG. 7, where a system is shown for supplying the coating material to the coating block 26. The coating material is stored within a tank 71, which is pressurized by the addition of air through the inlet 72 so as to cause the viscous material to leave the tank via pipe 73 towards the coating block 26. Since the material is under pressure, it would atuomatically flow out through the opening 29 in the coating block except for the fact that a valve, e.g., a pinch valve 74 is provided along the flow path 73. Accordingly, only when the valve is opened does material flow out through the opening 29 in the coating block 26. A light source 76a and a photosensitive diode 76b form a photoelectirc sensor, i.e., an electric eye for determining the passage of an article 1 along the conveying path. In one embodiment the sensor components can be arranged on opposite sides of the conveying path between the transfer arrangement and the coating arrangement. When an article passes between members **76*a* and 76*b*, an activating signal is applied to a solenoid 75 which in turn causes the valve 74 to be opened and enables material to be emitted from the coating block through opening 29. By providing a proper delay between the actuation of the sensor components and the opening of the valve, the material is emitted from the coating block through opening 29 in synchronization with the movement of the article 1** past the opening.

Figure 8A:
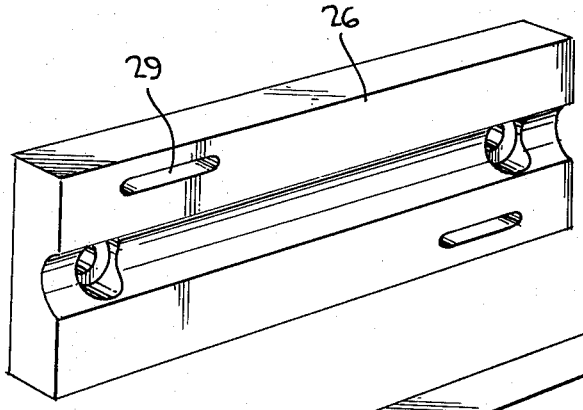
FIGS. 8*a* and 8*b* illustrate possible alternative embodiments of the coating block for the coating applicator in accordance with the present invention.
Figure 8B:
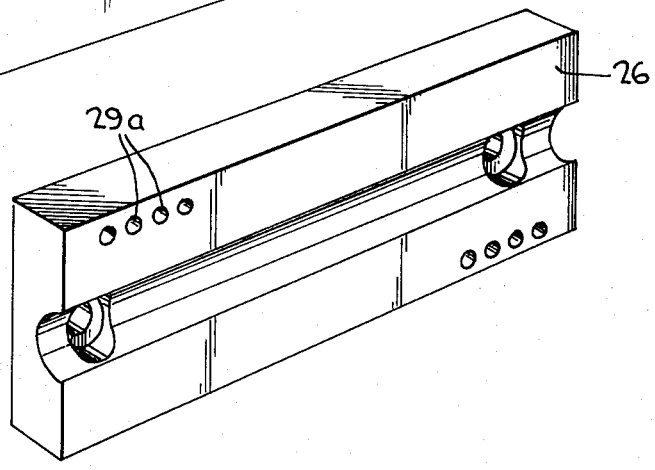

The opening 29 in the coating block 26 can be a slotlike opening as shown in FIG. 8a. Alternatively, the opening can be formed by a plurality of holes **29*a* which are aligned in a horizontal direction in the block 26*a* as shown in FIG. 8*b***. Other various embodiments of the openings in the coating block for emission of the coating material can be formed depending upon the length of the selected portion of the shank over which coating material is to be applied, such as, for example, the use of two rows of holes in the block. Each block is provided with openings at diagonally opposite ends so that when wear of the block has occurred at the top, the block can be rotated and the other end utilized.

It is noted that the above description and the accompanying drawings are provided merely to present exemplary embodiments of the present invention and that additional modifications of such embodiments are possible within the scope of this invention without deviating from the spirit thereof.

We claim:

1. An arrangement for applying a band of coating material around the shank of headed articles along a selected portion thereof, comprising: feeding means for supplying a plurality of such articles; conveyor means for conveying such articles along a predetermined path; transfer means for receiving such articles from said feed means, accelerating said articles to a predetermined speed and supplying them into positive engagement with said conveyor means while maintaining a predetermined minimum distance between each article; coating means arranged adjacent to said conveyor means along the path travelled by such articles for coating the shanks of such articles with the coating material; said conveyor means including a pair of generally parallel conveyor elements arranged within a plane extending in a substantially horizontal direction for conveying such headed articles so that their shanks extend in a vertical direction, means supporting said elements in a spaced relation, said conveyor elements being arranged with respect to said transfer means such that both of said conveyor elements positively grip each article while it is still in engagement with said transfer means, and means for moving one of said elements relative to the other in a direction from said transfer means towards said coating means; and means for maintaining said conveyor elements in a closely spaced relation to each other in the locations of both said transfer means and said coating means so as to frictionally grip the shanks of the articles for positively feeding said articles in succession along the predetermined path and past said coating means while maintaining the relative positions of the articles on the predetermined path.

2. An arrangement as defined in claim 1, wherein said feed means includes two bars arranged parallel to one another, one end of said bars providing an opening for receiving the articles and the other end of said bars being arranged adjacent to the input of said transfer means, and vibrating means for causing said bars to vibrate in order to cause the movement of the articles along said bars from its open end to said transfer means.

3. An arrangement as defined in claim 2, wherein said one end providing the opening between said bars for receiving the articles is arranged at a level above the horizontal path of said conveyor elements and a portion of said bars between said ends is sloped.

4. An arrangement as defined in claim 3, wherein said feed means further includes a guide plate adjustably positioned above said bars for preventing the articles travelling between said bars from leaving the path thereof.

5. An arrangement as defined in claim 1, wherein said transfer means includes a star wheel having a plurality of openings, each capable of receiving one of the articles, means for rotating said star wheel so that said openings travel past the output end of said feed means for receiving one of the articles and carrying the received article to said conveyor means.

6. An arrangment as defined in claim 5, wherein said transfer means further includes a guide block positioned adjacent to said star wheel and having one face thereof positioned at a substantially constant distance from the axis of said star wheel and a deflection plate for guiding the articles leaving said feed means on to said star wheel.

7. An arrangement as defined in claim 6, wherein said deflection plate is pivotable about a fixed axis so that it covers a portion of each of said openings in said star wheel when such opening is in a position for receiving an article from said feed means.

8. An arrangement as defined in claim 6, wherein said guide block has a curved surface at the location of the output of said feed means and said transfer means further includes a spring biased member and a spring for biasing said spring biased member perpendicular to the path of the output of said feed means so as to restrict the size of such path to the size of the shank of a single article, whereby if two articles become jammed in this area said spring biased member moves away from the path of the output of said feed means so as to expose the curved surface of said guide block thereby enabling one of the articles to pass and the jammed condition to be relieved.

9. An arrangement as defined in claim 1, wherein one of said conveyor elements is a stationary bar.

10. An arrangement as defined in claim 9, wherein said stationary bar has a projecting portion on its face against which the articles contact, said projecting portion extending along the length of said stationary bar.

11. An arrangement as defined in claim 1, wherein said coating means includes a supply tank for storing the coating material, a coating block having an opening therein adjustably positioned adjacent to the conveying path in the location along which the portion of the shank of the article to be coated will pass, and pressure means for forcing the coating material to travel from the supply tank to the opening within the coating block and to be emitted therefrom.

12. An arrangment as defined in claim 11, wherein said coating means further includes a smoothing block arranged subsequent to said coating block along the conveyor path for smoothing the coating material on the shank of the article.

13. An arrangement as defined in claim 11, wherein said pressure means includes a valve for selectively releasing the coating material through the opening in the coating block.

14. An arrangement as defined in claim 13, wherein said coating means further includes means for determining when each article enters the conveying path and means connected to said determining means for synchronizing the operation of the valve with the movement of the articles on the conveying path.

15. An arrangement as defined in claim 11, wherein said coating block has an elongated slot for releasing the coating material.

16. An arrangement as defined in claim 11, wherein said block has a plurality of holes aligned along a longitudinal direction for releasing the coating material.

17. An arrangement as defined in claim 1, further comprising cleaning means arranged on the opposite side of the conveying path of said coating means for removing coating material from a selected portion of the shank of the article which is to be free of coating material.

18. An arrangement as defined in claim 1, further comprising spraying means arranged subsequent to said coating means for spraying a water-soluble oil and a firming agent onto each of the articles.

* * * * *